US006192939B1

(12) United States Patent
Yao et al.

(10) Patent No.: US 6,192,939 B1
(45) Date of Patent: Feb. 27, 2001

(54) APPARATUS AND METHOD FOR DRIVING A MICROFLOW

(75) Inventors: Nan-Kuang Yao; Yue-Min Wan; Chi-chen Chen; Lung-Yu Hung; Shin-Hwan Wang; Si-Wei Chang, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/345,451

(22) Filed: Jul. 1, 1999

(51) Int. Cl.[7] ..... F15D 1/14

(52) U.S. Cl. ..... 138/39; 138/42; 366/340; 436/180

(58) Field of Search ..... 138/37, 39, 42; 366/106, 107, 176.1, 340, 341; 435/288.4, 288.5; 436/52, 180

(56) References Cited

U.S. PATENT DOCUMENTS 3,566,922 * 3/1971 Legg Nee Jouve et al. ..... 138/39
3,881,701 * 5/1975 Schoenman et al. ..... 259/4
4,886,369 * 12/1989 Hankison ..... 366/340
4,989,807 * 2/1991 Foreman et al. ..... 138/39
5,529,465 * 6/1996 Zengerle et al. ..... 417/413.2
5,632,876 * 5/1997 Zanzucchi et al. ..... 417/53
5,658,358 * 8/1997 Chyou et al. ..... 138/37
5,705,018 * 1/1998 Hartley ..... 156/345
5,842,787 * 12/1998 Kopf-Sill et al. ..... 366/340
5,921,678 * 7/1999 Desai et al. ..... 366/340

* cited by examiner

*Primary Examiner*—James Hook
(74) *Attorney, Agent, or Firm*—Bacon & Thomas

(57) ABSTRACT

A pneumatic apparatus and method for driving a microflow is disclosed. The microflow driving apparatus of this invention comprises an external pneumatic driving device that generates an array of airflows; an air gallery to accept airflows of said pneumatic driving device and to generate a suction force and an exclusion force; and a fluid channel connected with said air gallery to allow a fluid to flow inside it. In the air gallery, a trapezoid block is provided to generate an air circle from at least one of said airflows. An open gap is provided in the fluid channel at the connection of the air gallery and the fluid channel. When different combinations of airflows are introduced into the air gallery, a suction force or an exclusion force is generated to drive the reaction fluid inside the fluid channel to proceed, retreat or pause. A method using the apparatus for driving a microflow is also disclosed.

14 Claims, 2 Drawing Sheets

APPARATUS AND METHOD FOR DRIVING A MICROFLOW

FIELD OF THE INVENTION

The present invention relates to an apparatus and a method for driving a microflow, especially to an apparatus and a method to drive a fluid in small scales in, for example, a Micro total analysis system ($\mu$-TAS) with an external driving system. The present invention provides a non-connected pneumatic pumping system for microflows.

BACKGROUND OF THE INVENTION

The microchips for DNA sample processing and DNA-base sequence analysis are already commercialized. In this micro total analysis system, it is necessary to provide a driving system that drives the DNA sample or the biochemical reagent to flow along the microchannel inside the biochip. In designing the driving system, how to avoid pollution between the sample, the reagent and the driving system, is one of the major problems.

In designing the driving system of a biochip, three approaches may be selected. They are on-chip mechanical micropump, the on-chip electro-kinetic micropump and the external servo system.

1. The on-chip mechanical micropump

An on-chip mechanical micropump may be prepared directly by the micro-machining technology. If this approach is adopted, a moveable part shall be provided inside the microchannel of the chip. The "electrostatically driven diaphragm micropump" designed by Roland Zengerle et al. in their U.S. Pat. No. 5,529,465 is a good example.

In the Zengerle invention, the micropump includes a pressure chamber. A reciprocal pumping power is generated by electrostatics. With the help of two passive check valve, microflows are driven with a 350 $\mu$l/min working velocity.

A simplified "micromachined peristaltic pump" was disclosed by Frank T. Hartley in his U.S. Pat. No. 5,705,018. In this invention, a series of block flexible conductive strips are positioned in the internal wall of a microchannel. When a voltage pulse passes along the microchannel, the flexible conductive strips are uplifted in sequence by the electrostatics so generated, such that a peristaltic movement is generated. This peristaltic movement drives the microflow along the microchannel. In the Hartley invention, the working velocity is about 100 $\mu$l/min.

The on-chip mechanical micropump does not provide the function such that the chip may be repeatedly used for different samples. This is because a microchannel with moveable parts is difficult to clean up residual samples or biochemical reagents after the reaction. Another problem is that the on-chip mechanical micropump, especially the peristaltic pump, involves expensive material costs. These biochips are not suited for disposable applications.

2. The on-chip electro-kinetic micropump

The on-chip electro-kinetic micropump is a non-mechanical micropump. Inside the pump there are no moveable members. The driving force is generated by electro osmosis (EO), electro hydrodynamics (EHD) or electro phorosis (EP).

In 1997, Peter J. Zanzucchi et al. disclosed an "apparatus and method for controlling fluid flow in microchannels in their U.S. Pat. No. 5,632,876. In this invention the driving force of the microflow is a combination of electro-osmosis and electro-hydrodynamics.

The microfluid is driven by the EHD force and the EO force to proceed, retreat or pause. In using the EO force, the fluid shall be a polar solution. On the other hand, when the EHD force is used, the fluid shall be a non-polar solution, such as an organic solution. In this patent, Zanzucchi claimed that both polar and non-polar solutions are applicable in his invention, when necessary integration of the two forces are made.

In 1997 Paul C. H. Li and D. Jed Harrison published an article: "Transport, manipulation and reaction of biological cells on-chip using electrokinetic effects" in Anal. Chem., 1997, 69, 1564–1568. This article disclosed a microflow driving system using the combination of the EO force and the EP force. Due to the differences between the EP force and EO force in different channels and areas, the biochemical samples may be driven and even classified. However, no matter which force is the case, objects driven by the force are the electric particles in the solution, not the solution itself.

Although the on-chip electro-kinetic micropump is easy to prepared and its cost is low, there are several limitations. First, in the application, the microchannel(s) shall be filled with solutions in advance. It is not possible to introduce the sample or reagent into the channel before filling the channel with solutions. Secondly, an electro-kinetic micropump can only move a fluid to a limited distance. Its working velocity is about 10 $\mu$l/min. It is necessary to apply a bias of hundreds or even thousands volt within a very short distance. The operation cost is relatively high. Last but not least, the EHD pump can only apply to non-polar organic solutions and the EO pump and the EP pump may only apply to polar solutions where density of ion influences the driving efficiency of the pump. As a result, if a sample or reagent with complicated components is introduced, or if density of ion varies during the reaction, problems will occur in the flow driving system.

3. The external servo system

To use an external servo system to drive a microflow may be the simplest idea. If most moveable members are removed to outside of the microchannel, the structure of the microchannel must be simplified and the manufacture cost may be saved. This approach is obviously applicable to disposable biochips.

In designing an external servo system, one of the most important questions is how the "world-to-chip" interface may be designed such that the driving force may be connected to the fluid channel under miniature scales. If this problem may be solved, a simplified, low cost and disposable biochip, with no moveable member in the microchannel, may be obtained.

It is thus a need in the industry to provide an apparatus and a method for driving a microflow wherein the driving force is provided by an external driving device.

It is also a need in the industry to provide an apparatus for driving a microflow where no moveable member is required in the fluid channel for the microflow.

It is also a need in the industry to provide an apparatus for driving a microflow with lower manufacture costs.

It is also a need in the industry to provide an apparatus for driving a microflow with a simplified world-to-chip interface.

OBJECTIVES OF THE INVENTION

The purpose of this invention is to provide an apparatus and a method for driving a microflow wherein the driving force is provided by an external driving device.

Another purpose of this invention is to provide an apparatus for driving a microflow where no moveable member is required in the fluid channel for the microflow.

Another purpose of this invention is to provide an apparatus for driving a microflow with lower manufacture costs.

Another purpose of this invention is to provide an apparatus for driving a microflow with a simplified world-to-chip interface.

SUMMARY OF THE INVENTION

According to the present invention, a pneumatic apparatus and method for driving a microflow is disclosed. The microflow driving apparatus of this invention comprises an external pneumatic driving device that generates an array of airflows; an air gallery to accept airflows of said pneumatic driving device and to generate a suction force and an exclusion force; and a fluid channel connected with said air gallery to allow a fluid to flow inside it. In the air gallery, a trapezoid block is provided to generate an air circle from at least one of said airflows. An open gap is provided in the fluid channel at the connection of the air gallery and the fluid channel. When different combination of airflows is introduced into the air gallery, a suction force or an exclusion force is generated to drive a reaction fluid inside the fluid channel to proceed, retreat or pause. A method using the apparatus for driving a microflow is also disclosed.

The above and other objectives and advantages of the present invention may be clearly understood from the detailed description by referring to the following drawings.

Table I shows the relation between combinations of airflow as applied and direction and speed of the microflow as driven.

Table II shows flow speed of different fluid in the apparatus for driving a microflow of this invention.

DETAILED DESCRIPTION OF THE INVENTION

According to the present invention, a pneumatic apparatus and method for driving a microflow is disclosed. The microflow driving apparatus of this invention comprises an external pneumatic driving device that generates an array of airflows; an air gallery to accept airflows of said pneumatic driving device and to generate a suction force and an exclusion force; and a fluid channel connected with said air gallery to allow a fluid to flow inside it. In the air gallery, a trapezoid block is provided to generate an air circle from at least one of said airflows. An open gap is provided in the fluid channel at the connection of the air gallery and the fluid channel. When different combination of airflows is introduced into the air gallery, a suction force or an exclusion force is generated to drive a reaction fluid inside the fluid channel to proceed, retreat or pause.

In some embodiments of this invention, the series of airflows includes 5 airflows, the open gap is a triangle gap.

The following is a detailed description of the structure, theory and embodiments of the apparatus and method for driving a microflow of this invention.

Figure 1:
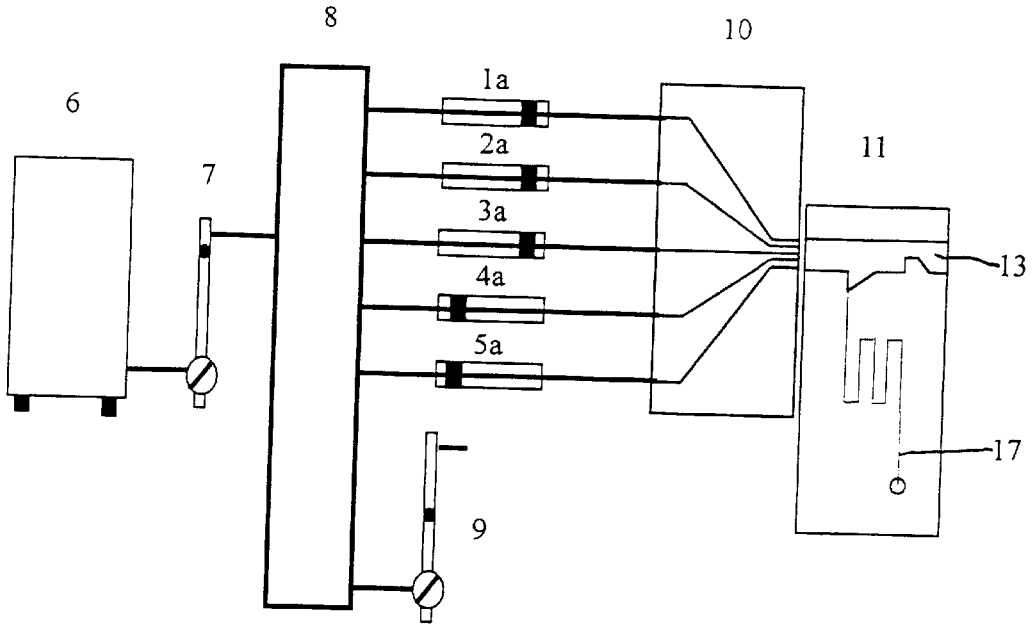
FIG. 1 illustrates the system diagram of the apparatus for driving a microflow of this invention.

FIG. 1 illustrates the system diagram of the apparatus for driving a microflow of this invention. As shown in this figure, the apparatus for driving a microflow of this invention comprises an external pneumatic driving device, an air gallery 13 and a fluid channel 17 connected with said air gallery. The air gallery 13 and the fluid channel 17 are provided in a reaction module 11, while the pneumatic driving device is external to the reaction module 11. The pneumatic driving device comprises 5 air ducts 1–5, an airflow injecting array 10 that includes five air injection outlets connected to said air ducts 1–5, respectively, an air compressor 6 to supply an airflow, an air pressure buffer tank 8, an inlet flowmeter 7 to control airflow into said air pressure buffer bottle 8 and an outlet flowmeter 9 to control the air pressure of the buffer bottle 8. In some embodiments, only one inlet flowmeter or one outlet flowmeter is used.

When the pneumatic driving device is enacted, an airflow is supplied by the air compressor 6 into the air pressure buffer bottle 8. The air pressure inside the buffer bottle 8 is controlled by the inlet flowmeter 7 and the outlet flowmeter 9. The airflow is then supplied to the 5 air ducts 1–5 through the control of their respective adjustment valves 1*a*–5*a*. To facilitate description, we define airflows supplied by the 5 air ducts 1–5 as airflows 1–5. The air ducts 1–5 are grouped at the airflow injecting array 10 whereby airflows 1–5 are generated at the airflow injecting array 10, respectively or collectively.

Figure 2:
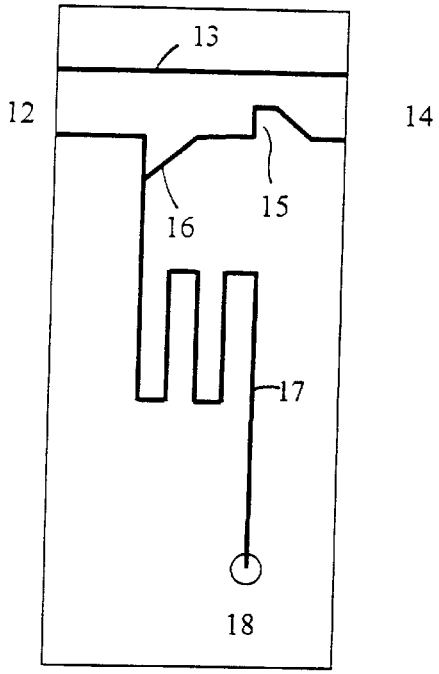
FIG. 2 illustrates the layout of the air gallery and the fluid channel of the apparatus for driving a microflow of this invention.

The structure of the reaction module 11 is shown in FIG. 2. As shown in this figure, the reaction module 11 includes an air gallery 13 and a fluid channel 17 for a reaction sample or reagent. In practice, the reaction module 11 is positioned adjacent to the air injecting array 10, with the inlet of the air gallery 13 aligned with the injecting outlet of the air injecting array 10. Also as shown in this figure, the air gallery 13 is a flat tunnel wherein its inlet 12 and outlet 14 have about the same cross-sectional area. The cross-sectional area of the inlet 12 of the air gallery 13 is approximately the same as that of the injecting outlet of the air injecting array 10.

Inside the air gallery 13 is an airflow trapezoid block 15. Provided at the terminal of the fluid channel 17 that connects with the air gallery 13 is an open gap 16. As shown in this figure, the open gap 16 is a triangle gap. Of course, the shape of the open gap 16 is not limited to triangle and may be decided according to the application of the biochemical reaction. The other terminal of the fluid channel is connected with a reaction fluid inlet well 18. The reaction fluid inlet well 18 is open to outside through the cover (not shown) of the reaction module 11, allowing addition of a reaction fluid.

When a biochemical reaction is to be conducted, a reaction sample and/or a reagent (hereinafter referred to as "reaction fluid") is added into the inlet well 18 of the reaction module 11. The reaction module 11 is placed adjacent to the air injecting array 10, with the inlet 12 of the air gallery 13 aligned with the outlet of the air injecting array 10. The driving modes of the driving apparatus include the followings:

1. When valve 3*a* is opened, and valves 1*a*, 2*a* and 4*a*, 5*a* are closed, airflow 3 is supplied to the air gallery 13. The reaction fluid is sucked into the fluid channel 17 at a higher speed.
2. When valves 1*a*–5*a* are opened, airflows 1–5 are supplied to the air gallery 13. The reaction fluid is excluded back to the inlet well 18 at a higher speed.
3. When valves 1*a*–3*a* are opened, and valves 4*a* and 5*a* are closed, airflows 1–3 are supplied to the air gallery 13. The reaction fluid is sucked into the fluid channel 17 at a lower speed.

4. When valves 1*a* and 4*a* are opened, and valves 2*a*, 3*a* and 5*a* are closed, airflows 1 and 4 are supplied to the air gallery 13. The reaction fluid pauses in the fluid channel 17.
5. When valves 1*a*–4*a* are opened, and valve 5*a* is closed, airflows 1–4 are supplied to the air gallery 13. The reaction fluid is excluded and retreats back to the inlet well 18 at a lower speed.

The working theory of the present invention will be described in the followings. Of course, the description of the working theory is only an illustration of the present invention and shall not be used to limit the scope of this invention.

Figure 3:
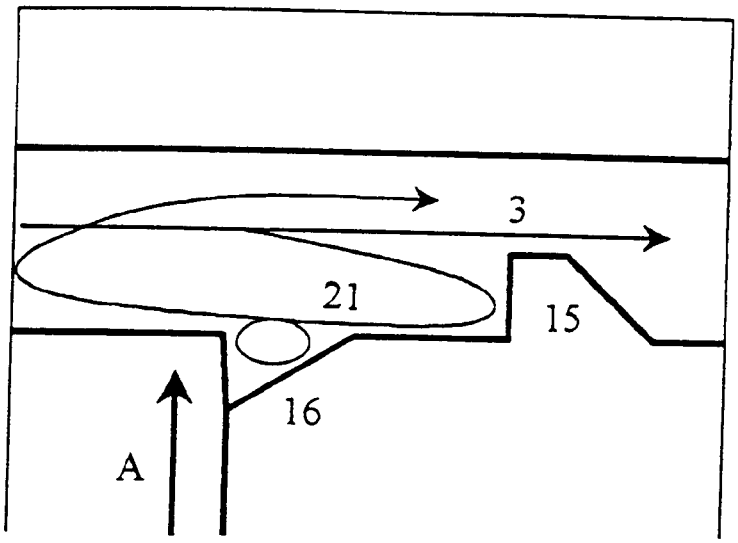
FIG. 3 illustrates the suction mode of the apparatus for driving a microflow of this invention.

FIG. 3 illustrates the suction mode of the apparatus for driving a microflow of this invention. As shown in this figure, when airflow 3 is supplied to the air gallery 13, it blows into the air gallery 13. A part of airflow 3 is retarded by the trapezoid block 15 and is forced to turn around. This flow is then brought to outlet of the air gallery 13 by the succeeding airflow 3 at a latter time and generates an air circle 21 between the trapezoid block 15 and inlet 12 of the air gallery 13. This air circle 21 generates a speedy eddy current at the area of the open gap 16 whereby the air inside the fluid channel 17 is sucked to the air gallery 13 by the bumping effect so caused and the reaction fluid is driven to proceed to the open gap 16 in a higher speed.

When airflows 1–3 are supplied to the air gallery 13, a division of the air circle 21 between the trapezoid block 15 and the inlet 12 of the air gallery 13 is conflicted by airflows 1 and 2. As a result, the bumping effect is moderated and the flow rate of the reaction fluid is reduced. Arrow A indicates the flow direction of the reaction fluid under the above suction modes.

Figure 4:
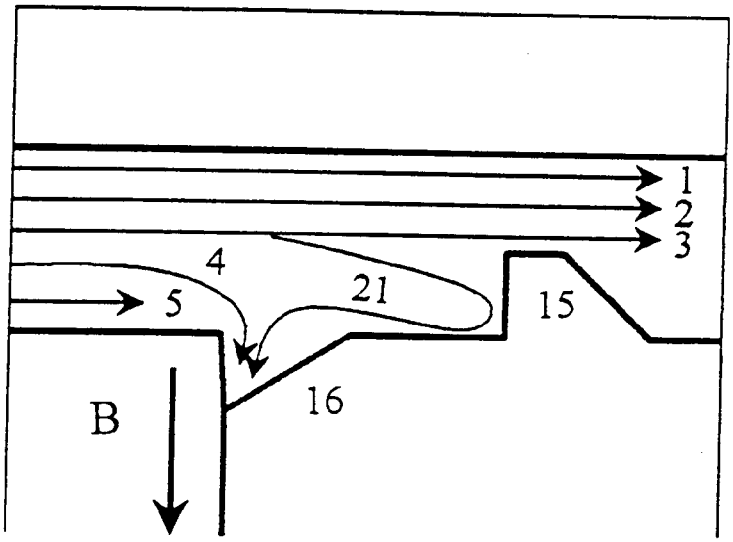
FIG. 4 illustrates the exclusion mode of the apparatus for driving a microflow of this invention.

FIG. 4 illustrates the exclusion mode of the apparatus for driving a microflow of this invention. As shown in this figure, when air flows 1–5 are supplied to the air gallery 13, the air circle 21 between the trapezoid block 15 and the inlet 12 of the air gallery 13 is conflicted by airflows 4 and 5. The airflow adjacent to the open gap 16 is almost stopped and a high pressure is thus generated. The high pressure blows into the fluid channel 17 from the open gap 16 such that the exclusion force so generated excludes the reaction fluid into the inlet well 18 at a higher speed.

When airflows 1–4 are supplied to the air gallery 13, only airflow 4 is conflicting air circle 21. The air pressure adjacent the open gap 16 is reduced such that the exclusion force so generated excludes the reaction fluid into the inlet well 18 at a lower speed. In this figure, arrow B indicates the flow direction of the reaction fluid under the above exclusion modes.

When airflows 1 and 4 are supplied to the air gallery 13, a weak air circle 21 is generated by airflow 1. This air circle 21 is conflicted by airflow 4. As a result, the Bernoullis effect of the air circle 21 is not sufficient to generated a suction force or an exclusion force at the open gap 16. The reaction fluid is sustained inside the fluid channel.

In order to illustrate the effect of this invention, several embodiments are conducted. Again, the embodiments are used to illustrate the present invention and shall not be used to limit the scope of this invention.

Embodiment 1

A reaction module sized 100 mm×50 mm×15 mm is prepared with a PMMA substrate. In the module an air gallery sized 50 mm×10 mm×1 mm and a fluid channel sized 1 mm×1 mm, with the length of 160 mm are prepared. The volume of the fluid channel is 160 μl. A trapezoid block approximately with the same relative size and position as shown in FIG. 2 is prepared. An inlet well with a depth of 5 mm and a diameter of 5 mm is prepared. 150 μl of blue ink is added into the inlet well. The reaction module is placed adjacent to the air injecting array of an external pneumatic driving system, with the inlet of the air gallery aligned with the outlet of the injecting array. Turn on the air compressor and adjust the airflow rate to about 31.25 ml/s for each airflow when valves 1*a*–5*a* are opened. The result is shown in Table I, which shows the relation between combinations of airflow as applied and direction and speed of the microflow as driven.

TABLE I

| Air No. | 1 | 2 | 3 | 4 | 5 | Total airflow rate (ml/s) | Mode | Microflow rate (μl/s) |
|---|---|---|---|---|---|---|---|---|
| | | | ON | | | 100 | Suction | 75 |
| | ON | ON | ON | ON | ON | 150 | Exclusion | 150 |
| | ON | ON | ON | | | 120 | Suction | 30 |
| | ON | | | ON | | 100 | Pause | — |
| | ON | ON | ON | ON | | 120 | Exclusion | 50 |

Embodiments 2–6

In order to verify whether this invention is applicable to a variety of reaction samples/reagents, the following materials are added into the inlet well of the experimental modules as describe in Embodiment 1: blue ink, fetal bovine serum (FBS), cell-culture medium RPMI-1640 plus 10% FBS, pure RPMI-1640 and pure water. Airflows 1, 2 and 3 are supplied to the air gallery and the total airflow rate is reduced to 60 ml/s. The flow speed of the media is measured and the results are shown in Table II.

TABLE II

| Medium | Flow rate (μl/s) |
|---|---|
| Blue ink | 16 |
| FBS | 19 |
| RPMI-1640 + FBS | 19.6 |
| RPMI-1640 | 20.4 |
| Water | 24 |

EFFECTS OF THE INVENTION

As described above the apparatus for driving a microflow of this invention is capable of driving a fluid to proceed, retreat and pause in a fluid channel and the speed of the microflow may be controlled. The pneumatic driving system as used in this invention has a simple structure and is easy to operate thus the cost of biochemical experiments may be greatly reduced and the interface between the driving device and the reaction module may be simplified.

In the present invention all driving airflows are blown into and out of the air gallery directly no matter in the suction or the exclusion mode. No cross-contamination between reaction fluid and the pneumatic driving device will be generated.

According to the present invention, no moveable members are required in the reaction module. Problems caused by moveable members in the prior art don't exist in this invention.

In the embodiments of this invention it is shown that the polarity or ion content of the fluid to be driven is irrelative to its driving efficiency. The invented pneumatic driving system of this invention has a wider scope of application than that of the electro-kinetic micropump.

The apparatus and method for driving a microflow of this invention is capable of driving a fluid in a wide variety of applications. Examples include introducing blood or sputum samples into a pre-treatment module of a biochip for DNA sample processing or DNA sequence identification. This invention provides a convenient and feasible driving system for biochemical reactions.

In the embodiments of this invention the airflow injecting outlet has a flat shape and the air injecting array consists of 5 airflows. In some other embodiments of this invention, however, the airflow injecting outlet may be a matrix and the air injecting array may consist of less than 5 (e.g., 3) or more than 5 (e.g., 6, 8, 9 etc.) airflows. While the flat air gallery is applicable in biochips with small scaled reaction modules, other shapes may be applicable to biochips for this or other applications.

In this invention, the open gap may be triangle or other shapes, depending on the purposes of the biochip. If necessary, a driving system without the open gap is also applicable.

Again, in the embodiments the trapezoid block is used to generate an air circle. Other means to generate an air circle is also applicable to this invention and provide similar effects.

As the embodiments of this invention show the apparatus and method for driving a microflow in one biochemical reaction module, it is possible to design a series of reaction modules in one single biochip, using the driving system of this invention. By controlling the valves of the airflow ducts the reaction fluid may be moved from one module to another, to conduct a series of biochemical reactions. A "lab on a chip" may thus be achieved.

As the present invention has been shown and described with reference to preferred embodiments thereof, those skilled in the art will recognize that the above and other changes may be made therein without departing from the spirit and scope of the invention.

What is claimed is:

1. An apparatus for driving a microflow, comprising:

an airflow generating device to generate an array of airflows with particular flow rates and blowing directions;

an air gallery to accept airflows generated by said airflow generating device; and a fluid channel connected with said air gallery, allowing a fluid to flow along it;

characterized in that said air gallery is flat and comprises an air circle generating means to generate at least one air circle inside said air gallery adjacent to said fluid channel which is a fluid microflow channel.

2. The device according to claim 1 wherein said air gallery comprises a flat tunnel with two open ends and said air circle generating means comprises a trapezoid block inside said air gallery.

3. The device according to claim 2 wherein said trapezoid block is positioned between an outlet end of said air gallery and the connection of said air gallery and said fluid channel.

4. The device according to claim 1, further comprising an open gap in said fluid channel at a section connected with said air gallery.

5. The device according to claim 4 wherein said open gap is a triangle gap with its wide opening adjacent to said air gallery.

6. A device according to claim 1, wherein the microchannel is in a microchip.

7. A device of claim 6, wherein the microchip is a biochip for DNA sample processing or sequence identification.

8. An module for driving a microflow, comprising:

an air gallery to accept external airflows; and a fluid channel connected with said air gallery, allowing a fluid to flow along it;

characterized in that said air gallery is flat and comprises an air circle generating means to generate at least one air circle inside said air gallery adjacent to said fluid channel, which is a microflow channel, when an external airflow or external airflows are applied.

9. A The module according to claim 8 wherein said air gallery comprises a flat tunnel with two open ends and said air circle generating means comprises a trapezoid block inside said air gallery.

10. The module according to claim 9 wherein said trapezoid block is positioned between an outlet end of said air gallery and the connection of said air gallery and said fluid channel.

11. The module according to claim 8, further comprising an open gap in said fluid channel at a section connected with said air gallery.

12. The module according to claim 11 wherein said open gap is a triangle gap with its wide opening adjacent to said air gallery.

13. A method for driving a fluid to proceed, retreat or pause in a fluid channel belonging to a reaction module comprising:

an air gallery comprising an air circle generating means to generate at least one air circle inside said air gallery; and a fluid channel connected with said air gallery;

said method comprising:

filling at least a section of said fluid channel with a fluid;

generating selectively one or more airflows with determined flow rates and flow direction;

supplying said airflow or airflows to said air gallery to generate an air circle to drive said fluid to proceed, retreat or pause in said fluid channel.

14. The method according to claim 13 wherein said air gallery comprises a flat tunnel with two open ends and said air circle generating means comprises a trapezoid block inside said air gallery.

* * * * *